US009863362B2

(12) United States Patent
Galvin

(10) Patent No.: US 9,863,362 B2
(45) Date of Patent: Jan. 9, 2018

(54) PISTON

(71) Applicant: George Frederic Galvin, Sidcup (GB)

(72) Inventor: George Frederic Galvin, Sidcup (GB)

(73) Assignee: George Frederic Galvin, Sidcup, Kent (GB)

( * ) Notice: Subject to any disclaimer, the term of this patent is extended or adjusted under 35 U.S.C. 154(b) by 243 days.

(21) Appl. No.: 14/430,910

(22) PCT Filed: Sep. 3, 2013

(86) PCT No.: PCT/GB2013/000367
§ 371 (c)(1),
(2) Date: Mar. 24, 2015

(87) PCT Pub. No.: WO2014/049309
PCT Pub. Date: Apr. 3, 2014

(65) Prior Publication Data

US 2015/0252750 A1 Sep. 10, 2015

(30) Foreign Application Priority Data

Sep. 26, 2012 (GB) ..... 1217145.0
Jun. 25, 2013 (GB) ..... 1311253.7

(51) Int. Cl.
*F02F 3/00* (2006.01)
*B21D 53/88* (2006.01)
(Continued)

(52) U.S. Cl.
CPC ..... *F02F 3/0084* (2013.01); *B21D 53/886* (2013.01); *B22F 3/15* (2013.01);
(Continued)

(58) Field of Classification Search
CPC ..... F02F 3/0084; F02F 3/0069; F02F 3/0015; B21D 53/886; B22F 3/15; B22F 3/24; B22F 5/008
See application file for complete search history.

(56) References Cited

U.S. PATENT DOCUMENTS 6,607,693 B1 8/2003 Saito
6,907,849 B2 6/2005 Galvin
7,334,554 B2 2/2008 Galvin

FOREIGN PATENT DOCUMENTS

CN 1318111 10/2001
CN 102269076 12/2011
(Continued)

OTHER PUBLICATIONS

Nitinol Material Data Sheet <https://confluentmedical.com/wp-content/uploads/2016/01/Material-Data-Sheet-Shape-Memory.pdf>.*
(Continued)

*Primary Examiner* — Jacob Amick
(74) *Attorney, Agent, or Firm* — Faegre Baker Daniels LLP

(57) ABSTRACT

A piston, (1) incorporates a pair of tear-drop shaped springs (6) acting, in use, between the crown (2) of the piston and an associated connecting rod (4) so as to bias the connecting rod away from the piston crown (2). The springs (6) are supported by support members (7 and 8), the springs being located substantially in the region of the piston crown (2). A carrier (5) is positioned within the piston (1), the carrier being slidably mounted within the piston for axial movement relative thereto, and being connected to the connecting rod (4) in such a manner that the springs (6) permit the carrier (5) to move axially relative to the piston crown (2). The springs (6) are made of a beta titanium alloy such as gum metal.

20 Claims, 4 Drawing Sheets

(51) Int. Cl.

| | |
|---|---|
| ***B22F 3/15*** | (2006.01) |
| ***B22F 3/24*** | (2006.01) |
| ***B22F 5/00*** | (2006.01) |

(52) U.S. Cl.

CPC ..... *B22F 3/24* (2013.01); *B22F 5/008* (2013.01); *F02F 3/0015* (2013.01); *F02F 3/0069* (2013.01); *B22F 2003/247* (2013.01); *B22F 2003/248* (2013.01); *F02F 2200/04* (2013.01)

(56) References Cited

FOREIGN PATENT DOCUMENTS

| | | | | |
|---|---|---|---|---|
| FR | 2944057 | | 10/2010 | |
| FR | 2944057 | A1 | 10/2010 | |
| GB | 2431451 | | 4/2007 | |
| GB | 2431451 | A * | 4/2007 | ..... F02F 3/0015 |
| JP | 2004162171 | | 6/2004 | |
| JP | 2006522895 | | 10/2006 | |
| JP | 2012137064 | | 7/2012 | |
| WO | WO 00/77267 | | 12/2000 | |
| WO | WO 00/77367 | A2 | 12/2000 | |
| WO | WO 2004/090306 | A1 | 10/2004 | |

OTHER PUBLICATIONS

International Search Report issued by the European Patent Office, dated Apr. 30, 2014; for International Application No. PCT/GB2013/000367; 4 pages.

Examination Report issued by the Japanese Patent Office, dated Oct. 11, 2016, for related Japanese Patent Application No. 2015-533679, 2 pages.

English translation of Examination Report issued by the Japanese Patent Office, dated Oct. 11, 2016, for related Japanese Patent Application No. 2015-533679, 3 pages.

Chinese Office Action issued by the State Intellectual Property Office of the P.R.C., dated Oct. 9, 2016, for related Chinese Patent Application No. 2013800611117; 10 pages.

English translation of Chinese Office Action issued by the State Intellectual Property Office of the P.R.C., dated Sep. 10, 2016, for related Chinese Patent Application No. 2013800611117; 12 pages.

"A New Multi-Functional Titanium Alloy", vol. 22, No. 3, May 2005, for related Chinese Patent Application No. 2013800611117; 5 pages.

English translation of "A New Multi-Functional Titanium Alloy", vol. 22, No. 3, May 2005, for related Chinese Patent Application No. 2013800611117; 5 pages.

A New Multi Functional Titanium Alloy "Gum Metal", Northwest Institute for Nonferrous Metal Research, Xi an 710016, China; vol. 22, No. 3, May 2005; 5 pages.

* cited by examiner

PISTON

BACKGROUND

This invention relates to a piston for an internal combustion engine.

A conventional internal combustion engine employs a crankshaft to convert the reciprocating motion of the piston(s) into output torque to propel a vehicle or act upon any other load. The crankshaft is inefficient in its ability to convert the power available from the fuel combustion into usable output torque. This is because combustion of the fuel/air mixture takes place a number of degrees before the top dead centre (TDC) position of the piston, dependent upon engine speed and load. The ignited fuel/air pressure forces cannot produce output torque when the piston is either before or at TDC as the connecting rod and the crank pin are producing reverse torque before TDC and are practically in a straight line at TDC so that there is no force component tangential to the crank circle. This results in most of the available energy being lost as heat. If ignition takes place too early, most of the pressure generated is wasted trying to stop the engine (as this pressure tries to force the piston in the opposite direction to which it is travelling during the compression stroke); and, if left too late, the pressure is reduced due to the increasing volume above the piston as it starts its descent for the power stroke. The optimum maximum pressure point varies from engine to engine, but is around 12° after TDC on average.

The specification of my UK patent 2 318 151 relates to a piston and connecting rod assembly for an internal combustion engine. The assembly comprises a piston, a connecting rod, and a spring, the connecting rod having a first end operatively associated with the piston for movement therewith, and a second end connectible to a rotary output shaft. The spring acts between the piston and the connecting rod to bias the connecting rod away from the crown of the piston. The piston is movable towards the second (small) end of the connecting rod by a distance substantially equal to the cylinder clearance volume height. One result of using a spring is that the assembly has a resonant frequency, the advantages of which are described in the specification of my International patent application WO 00/77367. This assembly will be referred to throughout this specification as an energy storage piston.

In use, ignition is timed, by conventional timing means to take place at a predetermined time before TDC, so that the expanding gases formed by the ignition combustion force the piston to descend rapidly within the cylinder during the power stroke. Prior to reaching TDC, however, the pressure in the cylinder will build up to a high value, and the piston is forced towards the crank pin, against the force of the spring. This compresses the spring, and increases the volume above the piston, causing a reduction in pressure and temperature in the cylinder. The lowered temperature reduces radiation losses and the heat lost to the cooling water and subsequently the exhaust, with the pressure being shared equally between the cylinder clearance volume and the spring. This energy stored in the spring is released when the piston has passed TDC, and leads to the production of increased output torque. This is achieved as the spring pressure is now combined with the cylinder pressure after TDC. A large proportion of this stored energy would otherwise have been lost as heat, owing to the fact that the fuel/air mixture must be ignited before TDC, which is a result of the requirement for the ignited fuel/air to reach maximum pressure by about 12° after TDC for optimum performance.

One problem with the type of energy storage piston disclosed in the above-mentioned patent specifications is the necessity to have relative movement between the connecting rod small end and the piston crown in order to store energy in the spring arrangement mounted between these two parts. This problem has manifested itself in wear of the spring arrangement and/or adjacent parts, this wear being due to the failure of the assembly to maintain rigid axial alignment between the moving parts. This misalignment can cause heavy wear, and sometimes leads to seizures between adjacent parts, particularly when the piston is on fill load.

The specification of my European patent application 1274927 describes an energy storage piston that has improved alignment properties. This piston incorporates a spring which is integrally formed with the piston, and is configured as a bellows spring, and is made of titanium.

The disadvantages of this bellows spring piston are that it is difficult to manufacture, and can suffer from excessive stress forces if overloaded. Thus, if the bellows spring is manufactured from an annular block of titanium by machining internal and external slots, these cannot be done without computer numerical control (CNC), and this is a costly exercise as it requires a considerable time input to generate the correct cross-section of the bellows to achieve a functional piston. Moreover, the machining of the slots results in a considerable wastage of expensive titanium, and each spring will have to be specifically designed for a given piston and its application. Furthermore, because of the curved internal and external portions of the bellows spring and the requirement that the opposite faces of adjacent leaves of the spring must be contoured in order to spread the stress concentrations, the gaps between adjacent leaves are relatively large—of the order of 3 mm—and this leads to excessive stress problems if overloaded. Thus, a bellows spring is produced which has a relatively few leaves per unit length, and these must take up the large stress forces to which the piston is subjected in use. Accordingly, the stress per leaf is relatively high, and this can lead to premature failure of the spring. An additional disadvantage of this type of bellows spring is that, in order to attempt to achieve the required stress and deflection figures, it occupies a comparatively large space, making piston design difficult. Thus, space that is required for other piston components has to compete with the space occupied by the bellows spring. Throughout this specification the term "leaves" should be taken to mean those parts of a bellows spring that form the corrugations of the spring.

Alternatively, if individual leaves of the spring are formed by stamping, and the leaves are diffusion bonded together to form a bellows spring, a more cost-effective bellows spring can be produced, but this still suffers from excessive stress problems owing to the relatively large gaps between the leaves which are inherent in a bellows spring having curved internal and external end portions and non-parallel leaf walls. Space problems also occur for the same reasons as outlined above.

The specification of my UK patent application 0216830.0 describes an energy storage piston incorporating a spring acting, in use, between the piston and an associated connecting rod so as to bias the connecting rod away from the crown of the piston. The spring is configured as a bellows spring having a plurality of substantially parallel leaves defining the corrugations of the bellows spring. The internal and external end portions of the spring that connect the leaves are of rectangular configuration, and the gaps between adjacent leaves are defined by substantially parallel surfaces.

This spring has the advantages of being easier to manufacture than earlier types of bellows spring, and it does not suffer to the same extent from over-stressing. It does, however, still occupy a lot of space within a piston, which results in difficulties in piston design.

The specification of my UK patent application 0218893.6 describes a piston incorporating spring means acting in use between the piston and an associated connecting rod so as to bias the connecting rod away from the crown of the piston. The spring means is configured as a generally circular cushion spring located substantially in the region of the piston crown and extending over substantially the entire transverse cross-section of the piston, the spring means being such as to permit the crown of the piston to move axially relative to the connecting rod.

The disadvantage of this cushion spring is that it needs to be manufactured from two identical members whose edges must be bonded together. Electron beam welding is the preferred bonding method, but this process results in the material in the weld region being taken above its Beta Transus temperature, which results in the material becoming brittle, thereby shortening its useful working life.

The specification of my European Patent Application 1616090 describes a piston incorporating two disc springs within the piston, the disc springs acting in use between the piston and an associated connecting rod. Circumferential edge portions of the disc springs are supported and separated by a substantially annular support member, the springs being located substantially in the region of the piston crown and extending over substantially the entire transverse cross-section of the piston. The springs permit the crown of the piston to move axially relative to the connecting rod. The support member is constituted by respective rings fixed to the circumferential edge portions of the disc springs, and by an annular band formed with curved support surfaces for rolling engagement with the rings.

The disc springs of this piston are made of Titanium 10-2-3. The disadvantage of this material is that it requires at least two discs to achieve the desired deflection, and even then the full load stresses are close to the fatigue limit. This leads to a relatively short working life for the springs.

The specification of my UK patent application 2431451 describes a piston incorporating a disc spring made of a super-elastic material such as Nitinol. This spring is much smaller than the rectangular bellows spring, so that it can be fitted into the space between the piston crown and the top of the carrier. Moreover, being smaller, it uses considerably less metal, and so leads to a piston having a reduced cost. Furthermore, the springs can be located entirely at the crown end of the piston, and so enables the carrier to be made of aluminium rather than titanium which was the case with the improved rectangular bellows spring design, thereby leading to a further materials cost reduction.

This spring is also much lighter than the rectangular bellows piston; and, due to the simplicity of its design, its manufacturing process is more economical, faster and simpler. Yet another advantage is that existing piston designs can easily be modified to accept this type of spring, thereby permitting existing internal combustion engines to be modified to take advantage of the improved efficiency and fuel conservation properties of the energy storage piston.

Unfortunately, testing of Nitinol springs in an internal combustion engine revealed that they heat up internally during operation causing their premature failure.

The present invention is based on the discovery of a beta titanium alloy called gum metal (also known as TNTZ), which is a unique alloy of high elasticity, ductility and yield strength, originally developed with a composition of 54.3% titanium, 23% niobium, 0.7% tantalum, 21% zirconium and 1% oxygen, and can exist over a range of compositions which also include vanadium and hafnium. Gum metal exhibits a super-elastic nature one digit higher in elastic deformation (2.5%) compared to general metallic materials, has an ultra-low elastic modulus with high strength, has a super-plastic nature permitting cold plastic working to 99% or more with no work hardening at room temperature, has ultra-high strength of more than 2000 MPa by applying a heat-treatment, and has a near zero linear expansion coefficient (Invar property) and a constant elastic modulus (Elinvar property) over a wide temperature range

SUMMARY

The present invention provides a piston incorporating spring means acting, in use, between the piston and an associated connecting rod so as to bias the connecting rod away from the crown of the piston, the spring means being located substantially in the region of the piston crown, the spring means being such as to permit the crown of the piston to move axially relative to the connecting rod, wherein the spring means is made of a material having a Young's modulus of 75 GPa or less, and a tensile elastic limit strength of 700 MPa or more.

Preferably, the spring material is a beta titanium alloy, and more preferably the beta titanium alloy is gum metal.

In a preferred embodiment, the spring means is constituted by two tear-drop shaped annular springs, each having an outer generally hemispherical edge portion which tapers to an inner generally hemispherical edge portion via planar surfaces.

Preferably, the outer, generally hemispherical edge portions of the two springs are in rolling engagement with one another, and the inner, generally hemispherical edge portions are in rolling engagement with respective first and second support members provided within the crown of the piston.

The piston may further comprise a carrier positioned within the piston, the carrier being slidably mounted within the piston for axial movement relative thereto, and being connected to the connecting rod in such a manner that the spring means permits the carrier to move axially relative to the crown of the piston.

Advantageously, the first support member is press-fitted to the crown of the piston, and the second support member forms part of the carrier.

Advantageously, the carrier is made of aluminium, preferably coated with a friction-reducing material such as kerotine.

Conveniently, the carrier is slidably mounted within the cylindrical wall of the piston over substantially its entire length.

The spring material may be such as to remain in the working condition temperature range. The predetermined temperature range may be from substantially −25° C. to at least 300° C. This ensures that the spring material does not go too soft or too hard.

Preferably, the beta titanium alloy is substantially a blend of titanium, niobium, tantalum, zirconium and oxygen.

In a preferred embodiment, the piston further comprises a pair of vertically-spaced oil chambers formed at the peripheral portion of the carrier, each oil chamber being defined by a portion of the carrier and an internal cylindrical wall of the piston, the oil chambers being interconnected by a plurality of holes formed in the carrier, one of the oil chambers having a maximum volume when the springs are compressed and a minimum volume when the springs are uncompressed and the other oil chamber having a minimum volume when the springs are compressed and a maximum volume when the springs are uncompressed, whereby oil is pumped between the oil chambers to lubricate the interior of the piston as the carrier moves upwards and downwards with respect to the piston crown.

Preferably, each of the springs is formed by:—

(a) converting the beta titanium alloy into a powder;
(b) pouring the beta titanium alloy in its powder form into a tear-drop shaped mould;
(c) hot isostatically pressing the powered beta titanium alloy to the required shape; and
(d) cold working the pressed beta titanium alloy; and
(e) machine turning to the required shape.

Each of the springs may be heat treated following cold working.

The invention also provides a piston incorporating spring means acting, in use, between the piston and an associated connecting rod so as to bias the connecting rod away from the crown of the piston, the spring means being located substantially in the region of the piston crown, and the spring means being such as to permit the crown of the piston to move axially relative to the connecting rod, wherein the spring means is constituted by two tear-drop shaped annular springs made of a beta titanium alloy.

The invention further provides a method of manufacturing a spring for the piston defined above, the method comprising the steps of:—

(a) converting the beta titanium alloy into a powder;
(b) pouring the beta titanium alloy in its powder form into a tear-drop shaped mould;
(c) hot isostatically pressing the powdered beta titanium alloy to the required shape; a
(d) cold working the pressed beta titanium alloy; and
(e) machine turning to the desired shape.

The method may further comprise the step of heat treating each of the springs following cold working.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible The invention will now be described in greater detail, by way of example, with reference to the drawing, in which:—

DETAILED DESCRIPTION

Figure 1:
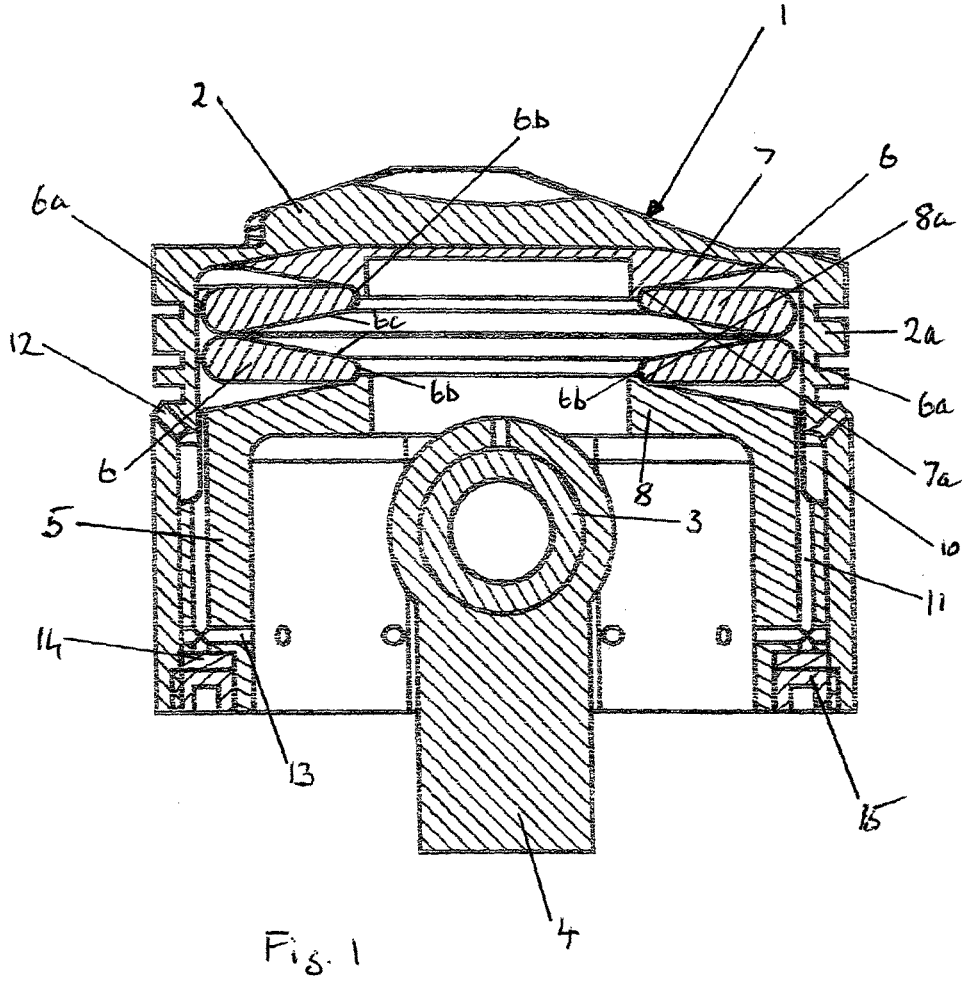
FIG. 1 is a sectional view of an energy storage piston constructed in accordance with the invention; and shows the piston in a first operating condition.

Referring to the drawings, FIG. 1 shows a hollow piston 1 of an internal combustion engine, the piston being reciprocable in a cylinder (not shown) lined with cast iron, steel or any other appropriate material in a conventional manner. The piston 1 is made of aluminium, and has a crown 2 having a downwardly-depending annular sleeve 2*a* which defines the peripheral cylindrical surface of the piston. In use, the piston 1 turns a crankshaft (not shown) by means of a gudgeon pin 3, a connecting rod 4, and a crank pin (not shown), all of which can be made of titanium, aluminium, steel, a magnesium alloy, a plastics material or any other suitable material. The gudgeon pin 3 is fitted within a cylindrical aperture 5*a* formed within a cylindrical carrier 5 made of aluminium and coated with keronite or any other suitable friction-reducing material. The gudgeon pin 3 is held axially in place by anti-rotation pegs 3*b* fitted in each end of its ends, or by any other suitable means. This prevents lateral movement of the gudgeon pin 3 within the carrier 5. The carrier 5 is held in position by the gudgeon pin 3.

Figure 2:
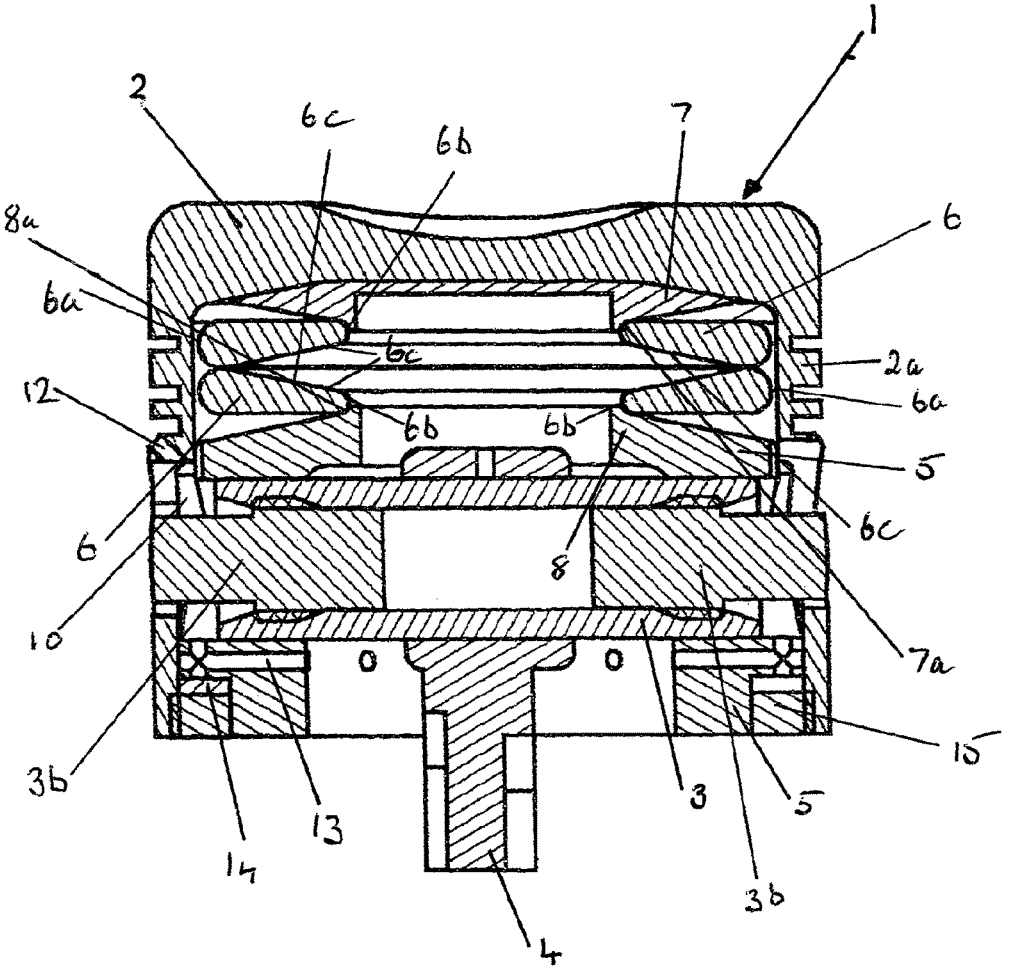
FIG. 2 is another sectional view of the energy storage piston of FIG. 1, and shows the piston in the first operating condition.

Referring to FIG. 2, the connecting rod 4 passes through a generally rectangular aperture 5*b* formed in the carrier 5, and is connected to the gudgeon pin 3. The rectangular aperture 5*b* is at right-angles to the cylindrical aperture 5*a*. A pair of annular springs 6 are positioned within the piston 1, between a downwardly-facing, steel support ring 7 which is a press fit within the piston 1 adjacent to the piston crown 2, and an upwardly-facing support ring 8 forming part of the carrier 5. Alternatively, the support ring 8 could be made of steel and be a press fit within the carrier 5.

Each of the springs 6 is an annular disc spring made of gum metal, and has a tear-drop shaped cross-section, that is to say it has an outer, generally hemispherical edge portion 6*a* which tapers towards an inner, generally hemispherical edge portion 6*b* via planar surfaces 6*c*. The inner edge portions 6*b* of the springs 6 are in rolling engagement with curved portions 7*a* and 8*a* formed respectively on the lower and upper surfaces of the rings 7 and 8. The outer edge portions 6*a* of the springs 6 are in rolling engagement one with the other. The gum metal has a Young's modulus of 75 GPa or less, and a tensile elastic limit strength of 700 MPa or more. In practice, the Young's modulus can vary between about 75 GPa at room temperature and about 35 GPa at the working temperature (typically 200° C.) of the piston 1. Similarly, the tensile elastic limit strength can vary between about 700 MPa at room temperature and 1200 MPa at the working temperature of the piston 1.

In order to manufacture each of the springs 6, gum metal is converted into a powder, is poured in its powder form into a tear-drop shaped mould, and is then hot isostatically pressed to the required shape. Cold working is then applied to each of the springs 6 to decrease its elastic modulus with reported shear modulus as low as 20 GPa. Cold working also increases the yield strength of each of the springs 6. If greater yield strength is required, the springs 6 can be heat treated after cold working, though some elasticity will then be sacrificed. In this way, yield strength ranging as high as 2 GPa, can be achieved which is on a par with some of the strongest steels. A combination of hot and cold working gives the super elastic springs its desired characteristics.

The lower end of the carrier 5 is fixed by the gudgeon pin 3 to the connecting rod 4, and the piston 1 is axially movable relative to the carrier, and hence is relatively movable with respect to the gudgeon pin 3 and the crank pin. The arrangement is such that the piston crown 2 is able to move towards the crank pin by a maximum distance approximately equal to the cylinder clearance volume height (the distance between the mean height of the piston crown 2 and the mean height of the top of the combustion chamber). The springs 6 thus bias the gudgeon pin 3 away from the piston crown 2.

In use, ignition is timed, by conventional timing means (not shown), to take place at a predetermined time before TDC, so that the expanding gases formed by the ignition combustion force the piston 1 to descend rapidly within the cylinder during the power stroke. Prior to reaching TDC, however, the pressure in the cylinder will build up to a high value, and the piston 1 is forced towards the crank pin, against the force of the springs 6, with respect to the carrier 5. This compresses the springs 6, and increases the volume above the piston 1, causing a reduction in pressure and temperature in the cylinder The piston is designed with a pair of springs 6 such that the clearance volume height is half of that which it would have been with a standard piston, i.e. the compression ratio is doubled. (Doubling the compression ratio in a standard engine would have a damaging or detrimental effect on the engine's performance). However, when ignition takes place, the expanding gases move the piston crown 2 downwards such that the original compression ratio is restored. This loads the springs 6 to restore the gas pressure to that which it would have been had the springs not have been installed. This results in that the sum of the spring force and the gas force acts on the piston crown 2. Clearly, this results in approximately twice the force being available on the piston crown 2, resulting in twice the power available. The throttle, therefore, has to be set to approximately half the original opening to obtain a reasonable "tick over" speed.

Further to the above, the springs 6 store half of the ignited gas energy, and this energy can only be released after TDC where the piston acts as a pressure regulator until the energy stored in the springs is fully released. This action, because it takes place after TDC, and the time it takes for the springs 6 to release their energy, ensures that the torque is much greater in the sprung piston engine than in the conventional engine.

Figure 3:
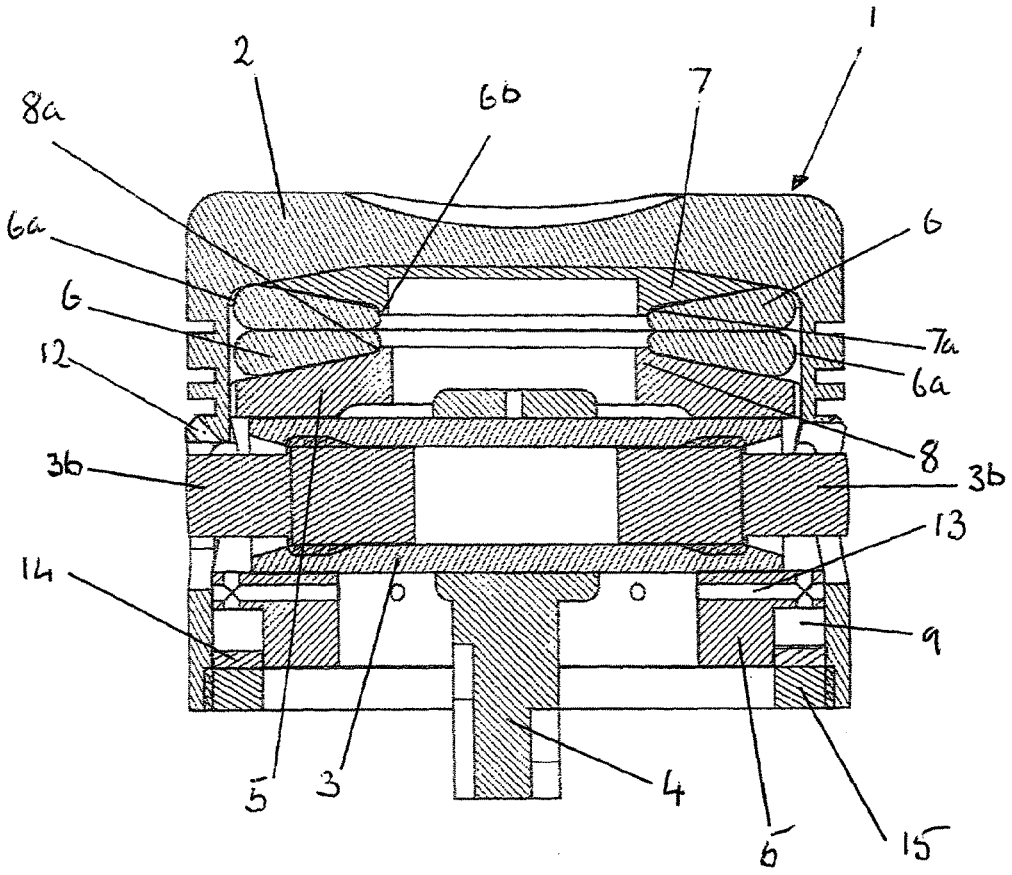
FIG. 3 is a sectional view similar to that of FIG. 1, and shows the piston in a second operating condition.

As pressure is applied during combustion, the edge portions 6*b* of the springs 6 move towards one another (from the position shown in FIGS. 1 and 2) as the edge portions 6*a* roll upon each other until the adjacent planar surfaces of the springs are in contact (see FIG. 3). The displacement of the springs 6 allows the piston crown 2 to descend with respect to the connecting rod 4 and the carrier 5, such that the cylinder volume above the piston 1 is doubled at maximum pressure, thereby storing energy in the springs 6 that would otherwise be lost as heat through the cylinder walls. The stored energy is then released when the crank is at a more advantageous angle to generate additional torque.

The springs 6 and the rings 7 and 8 are so configured that, at the maximum pressure of combustion, the springs 6 are fully compressed (see FIG. 3) so that their adjacent planar surfaces 6*c* are in contact, thereby preventing over-stressing of the springs, and hence possible premature failure. The maximum compression depends upon the post-ignition pressure and the crank shaft movement, and the springs 6 are appropriately configured to reach the required maximum deflection before over-stressing occurs.

As the springs 6 are compressed, they oppose the forces being applied due to their stiffness, this stiffness being measured in Newtons/meter displacement. The lowered temperature which results from the compression of the springs 6 reduces radiation losses and the heat lost to the cooling water and subsequently the exhaust, with the pressure being shared equally between the cylinder clearance volume and the springs. This energy stored in the springs 6 is released when the piston 1 has passed TDC, and leads to the production of increased output torque. This is achieved as the energy is released by the springs 6, and is combined with the cylinder pressure after TDC at a time when the crank arm is at a more advantageous angle to produce torque. A large proportion of this stored energy would otherwise have been lost as heat, owing to the fact that the fuel/air mixture must be ignited before TDC, which is a result of the requirement for the ignited fuel/air to reach maximum pressure by about 12° after TDC for optimum performance. Gum metal (optimally treated as described above) is the preferred material for making the springs 6, because of its mechanical as well as super-elastic properties.

The action of this arrangement means that, when the engine is firing normally, there will be movement of the piston 1 with respect to the connecting rod 4 (and hence to its crank pin) on every power stroke. The ignition timing of the engine is such that ignition occurs between approximately 10° and 40° before TDC, depending upon the engine's load and speed.

The versatility of gum metal has made this invention possible. Moreover, the spring design is unique in that the two tear-drop shaped springs 6 have been designed to touch together at their outer radiuses with their inner radiuses acted upon by the support rings 7 and 8. Friction is eliminated by the rolling action of the springs 6 at their outer edge portions 6*a*, and is confined to limited friction at their inner edge portions 6*b*. Furthermore, the design of the springs 6 is such as to spread the maximum stresses evenly over the flat surfaces 6*c*. The springs 6 are designed to double the clearance volume height at full load such that the action of the springs is to travel half the clearance volume height at full load. This means that the forces on the piston 1 are doubled, allowing the throttle position to be halved for similar results as before. Recent rolling road tests on a motor cycle fitted with the pistons 1 resulted in a 25% to 40% reduction in fuel flow during testing.

The main effect of providing the energy storage springs 6 is to reduce considerably the engine fuel consumption without reducing its power output. Not only is the efficiency of the engine improved, but the exhaust emissions are also reduced. The nitrous oxide emissions are greatly reduced and, by increasing the efficiency of the engine, unburnt hydrocarbon emissions are also reduced.

In a standard internal combustion engine, an exhaust valve is usually opened before the associated piston reaches bottom dead centre (BDC) to allow the continuing expanding gases to rush out of the exhaust, thereby assisting the entrance of a fresh charge of fuel and air into the cylinder during valve overlap (that is to say when both the inlet and outlet valves are open), such that the exhaust gases are effectively scavenged from the combustion chamber. The act of opening the exhaust valve early promotes the emission of unburnt hydrocarbons, and prevents the continuing expanding gases from providing mechanical rotation of the crankshaft, as these gases are vented to atmosphere.

The use of the springs 6 allows more efficient use of the fuel/air mixture. Moreover by using an increased compression ratio, the springs allow the use of a cam shaft designed such that the exhaust valve remains closed until almost BDC thereby effectively clearing most of the exhaust gases from the combustion chamber without the need to release the pressure in the cylinder by opening the exhaust valve early. This late opening of the exhaust valve cam design can be applied advantageously to any engine utilising the springs 6.

The use of the springs 6, coupled with the mass of the engine's flywheel, gives the whole assembly a frequency (rpm) at which it is resonant. This would be used to advantage when employed in an engine designed to run at a constant speed, as most engines are now so designed.

The principle of increasing engine efficiency and reducing exhaust emissions is described in the specification of my UK patent 2 318 151, and the piston 1 described above thus has all the advantages of that piston.

The piston 1 described above has all the advantages of the piston described in the specification of my European patent application 1274927. This piston also has advantages when compared with the improved rectangular bellows spring described in the specification of my UK patent application 0216830.0. In particular, the springs 6 are much smaller than the rectangular bellows spring, so that they can be fitted into the space between the piston crown 2 and the top of the carrier 5. Moreover, being smaller, they use considerably less metal, and so lead to a piston having a reduced cost. Furthermore, the use of the springs 6, which are located entirely at the crown end of the piston, enables the carrier 5 to be made of aluminium rather than titanium which was the case with the improved rectangular bellows spring design, thereby leading to a further materials cost reduction.

The springs 6 are also much lighter than the rectangular bellows piston; and, due to the simplicity of its design, its manufacturing process is more economical, faster and simpler. Yet another advantage is that existing piston designs can easily be modified to accept the springs 6, thereby permitting existing internal combustion engines to be modified to take advantage of the improved efficiency and fuel conservation properties of the energy storage piston.

Lubrication of the carrier 5 within the piston 1 is provided by oil within a pair of chambers 9 and 10, the chamber 9 (see FIG. 3) being formed at the base of the carrier 5, and the chamber 10 (see FIG. 2) being formed at the upper end of the carrier. The two chambers 9 and 10 are interconnected by twelve holes 11 (see FIG. 1) drilled in the carrier 5. The chamber 10 is in fluid communication with oil present in the interior of the cylinder by means of twelve passages 12, each of which is associated with a respective hole 11. The chamber 9 is connected to the interior of the piston 1 by twelve passages 13, each of which is associated with a respective hole 11. As the springs 6 are compressed, the carrier 5 moves upwards with respect to the piston crown 2, so that oil is pumped from the chamber 10 to the interior of the piston 1 via the twelve holes 11 and the twelve passages 13, this oil being supplied from the interior of the cylinder via the passages 12. This relieves oil pressure and prevents hydraulic locking of the carrier 5 within piston 1. As the springs 6 are de-compressed, the carrier 5 moves downwards with respect to the piston crown 2, so that oil is pumped from the chamber 9 to the chamber 10 and then upwards to lubricate the springs 6. The volume of the chamber 9 is a minimum when the springs 6 are decompressed and the carrier 5 is at its lowest position, and the volume of the chamber 10 is then at a maximum. The volume of the chamber 9 is a maximum when the springs 6 are compressed and the carrier 5 is at its highest position, and the volume of the chamber 10 is then at a minimum. During the action of the piston 1, the carrier 5 is always brought to the "relaxed" position shown in FIGS. 1 and 2, but to avoid noise emanating; from the metal-to-metal contact when the carrier 5 comes to rest a Viton or Kalrez ring 14 is provided to absorb noise. And act as a buffer. Kalrez is the preferred material as Viton emits noxious fumes if burnt, which can be harmful to health.

A further advantage of the piston 1 previously described is that the carrier 5 is firmly held in axial alignment within the piston 1 body, as the carrier will be subject to substantial sideways thrusts. Thus when a non-axial load is imparted to the carrier 5 due to the departure of the connecting rod 4, carrier 5 is firmly held in axial alignment within the piston body. Consequently, the carrier 5 has substantially improved resistance to wear and can be coated with a suitable material to prevent galling. The whole of the carrier 5 and Viton/Kalrez ring 17 are retained in the piston 1 which is firmly locked into place by a locking ring 15.

The essence of the piston described above is that the springs 6 allow the spring rate to be progressive, thereby allowing, pro rata, more deflection for lighter loads. Consequently, it is more compatible with the normal loading on the piston of a conventional automobile internal combustion engine, so that the economic advantage will be more pronounced at lower and medium loads rather than at high loads. Alternatively, the springs 6 could be designed to favour a heavy load application if necessary.

Another advantage of the support ring 7 contacting the springs 6 is that more vertical space is available within the body of the piston 1, thereby enabling the efficient inclusion of all necessary components, without sacrificing strength or reliability.

Additional advantages of using a beta titanium alloy such as gum metal for making the springs 6, are that the springs:—

1) are corrosion resistant;
2) have a low Young's modulus;
3) have a high yield strength;
4) have super-elastic properties; and
5) have a maximum strain of around 4%

All the above factors make this material ideally suitable for use as the spring element in an energy storage piston, allowing more room for its improved deflection qualities so that the piston can operate efficiently.

In the current design of the piston 1, the compression ratio is doubled. The effect of doubling the compression ratio is to double the pressure within the cylinder. This on its own would cause severe detonation of the fuel and probably damage to the piston 1 However, the inclusion of the springs 6 allows for pressure to fall when they are compressed to half of the peak value with the spring force adding the other half. This on its own would necessitate a 50% closure of the throttle, but maintains the engine's tick-over rpm, the 50% closure being the new throttle stop and hence tick-over position. Furthermore, the springs 6 act as a pressure regulator releasing their energy to keep the pressure above the piston virtually constant until the piston has travelled to such a crank position as to greatly increase the torque due to a rising turning arm. This brings the resultant torque to be at a higher figure than a conventional engine.

Figure 4:
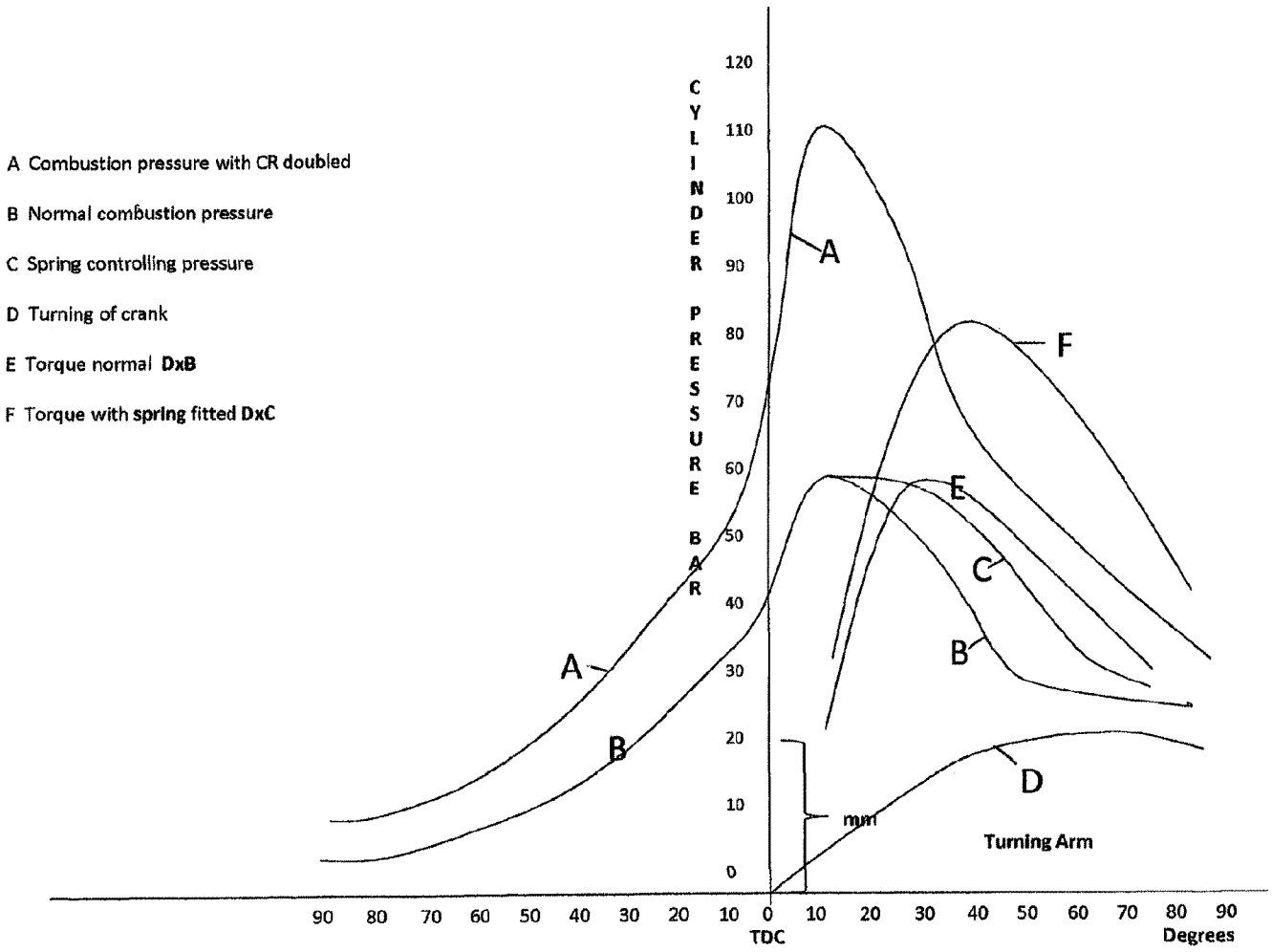
FIG. 4 is a graphical representation comparing the pressures, torques etc of the piston of FIGS. 1 to 3 and a conventional piston.

Curves shown on the graph (FIG. 4) labelled A to F show pressure and torque in the piston 1 described above and in a conventional piston. The curves C and F are for the piston 1, and the curves A, B and E are for a conventional piston. The curves are:

A. A pressure curve for a conventional piston but having double the normal compression ratio. An increased compression ratio is desirable as it increases the pressure applied to a piston, and hence the torque and power output. In practice, a doubled compression ratio is not feasible, as it results in "pinking". The curve is shown, however, to provide a comparison with the pressure curve C.
B. A pressure curve for a conventional piston with a normal compression ratio and at half throttle.
C. A pressure curve for the piston 1 with a spring-regulated compression ratio and at half throttle.
D. The crank turning arm.

E. A curve showing the torque if a conventional piston with a normal compression ratio at half throttle.

F. A curve showing the torque of the piston 1 with a spring-regulated compression ratio at half throttle.

By comparing the curves B and C, it will be seen that the piston 1 has an increased pressure for up to about 40° after TDC, and hence results in a substantially greater torque. This is because the crank arm is at a more advantageous (i.e.) greater angle so as to produce more torque. Moreover, by comparing the curves E and F, it will be seen that the piston 1 does indeed produce greater torque than a conventional piston It can also be seen, from the graph, that most of the fuel saving can be achieved by being able to run the piston 1 at half throttle, and this must be set by the "throttle stop" screw or ECU adjustment at commencement.

Although the energy storage piston described above forms part of an internal combustion engine, it will be apparent that it could be used, to advantage, in other devices such as a compressor for a refrigerator or a pump. The action of a reciprocating compressor is such that the compression stroke is the working stroke, and the energy input is typically by an electric motor. In an air compressor, for example, the maximum work is done at around 80° to 100° before TDC, when the crank arm is substantially normal to the connecting rod. At this position, the compressed gas pressure will be relatively low (less than 50% of maximum), because the volume of the compression chamber is still relatively high. When the piston is nearing TDC, however, its ability to do work is greatly reduced, but the pressure and temperature are both at a maximum. The outlet valve of the compressor would have opened before TDC, but energy would have been lost as heat to the cylinder walls at this time.

If a suitably designed energy storage piston with a spring of the type described above is fitted into this compressor, however, energy would be stored in the spring at around 80° to 100° before TDC, thereby reducing the temperature and pressure of the gas, and hence reducing the energy lost as heat to the cylinder walls and reservoir. The springs would discharge their energy by propelling the gas into the reservoir at around TDC, when the crank arm compressive movement is the least.

Moreover, it can be seen that these springs, working in conjunction with the rotating inertial mass (of the flywheel, crank etc), will have an rpm at which they are resonant. By matching the rpm of the drive motor to the resonant rpm, the assembly will run at its optimum efficiency of at least 30% above that of a standard compressor.

It will be apparent that modifications could be made to the piston 1. For example, the use of gum metal is not essential, as any other suitable beta titanium alloy having the requisite Young's modulus and tensile elastic limit strength could be used. It would also be possible, where space at the piston crown permits to use two or more pairs of springs 6. It would also be possible to make the springs 6 by any suitable method.

The invention claimed is:

1. A piston, comprising:

a piston crown; and at least one spring acting, in use, between the piston crown and an associated connecting rod so as to bias the connecting rod away from the piston crown, the spring being located substantially in the region of the piston crown, the spring being such as to permit the crown of the piston to move axially relative to the connecting rod, wherein the spring is made of a material having a Young's modulus of 75 GPa or less, and a tensile elastic limit strength of 700 MPa or more, wherein the spring material is cold worked and heat treated Gum Metal (an alloy of titanium, niobium, tantalum, zirconium and oxygen).

2. A piston as claimed in claim 1, comprising two springs constituted by two tear-drop shaped annular springs.

3. A piston as claimed in claim 2, wherein each of the springs has an outer, generally hemispherical edge portion which tapers towards an inner, generally hemispherical edge portion via planar surfaces.

4. A piston as claimed in claim 3, wherein the outer, generally hemispherical edge portions of the two springs are in rolling engagement with one another, and the inner, generally hemispherical edge portions are in rolling engagement with respective first and second support members provided within the crown of the piston.

5. A piston as claimed in claim 4, further comprising a carrier positioned within the piston, the carrier being slidably mounted within the piston for axial movement relative thereto, and being connected to the connecting rod in such a manner that the springs permit the carrier to move axially relative to the crown of the piston.

6. A piston as claimed in claim 5, wherein the first support member is press-fitted to the crown of the piston, and the second support member forms part of the carrier.

7. A piston as claimed in claim 4, wherein the carrier is made of aluminium.

8. A piston as claimed in claim 7, wherein the carrier is coated with a friction-reducing material.

9. A piston as claimed in claim 8, wherein the friction-reducing material is kerotine.

10. A piston as claimed in claim 4, wherein the carrier is slidably mounted within the cylindrical wall of the piston over substantially its entire length.

11. A piston as claimed in claim 4, further comprising a pair of vertically-spaced oil chambers formed at the peripheral portion of the carrier, each oil chamber being defined by a portion of the carrier and an internal cylindrical wall of the piston, the oil chambers being interconnected by a plurality of holes formed in the carrier, one of the oil chambers having a maximum volume when the springs are compressed and a minimum volume when the springs are uncompressed and the other oil chamber having a minimum volume when the springs are compressed and a maximum volume when the springs are uncompressed, whereby oil is pumped between the oil chambers to lubricate the interior of the piston as the carrier moves upwards and downwards with respect to the piston crown.

12. A piston incorporating spring means acting, in use, between the piston and an associated connecting rod so as to bias the connecting rod away from the crown of the piston, the spring means being located substantially in the region of the piston crown, and the spring means being such as to permit the crown of the piston to move axially relative to the connecting rod, wherein the spring means is constituted by two tear-drop shaped annular springs made of a beta titanium alloy.

13. A piston as claimed in claim 12, wherein the annular springs are made of cold worked and heat treated Gum Metal (an alloy of titanium, niobium, tantalum, zirconium and oxygen).

14. A piston, comprising:

a piston crown; and at least one spring acting, in use, between the piston crown and an associated connecting rod so as to bias the connecting rod away from the piston crown, the spring being located substantially in the region of the piston crown, the spring being such as to permit the crown of the piston to move axially relative to the connecting rod, wherein the spring is made of a material having a Young's modulus of 75 GPa or less, and a tensile elastic limit strength of 700 MPa or more, wherein the spring comprises two tear-drop shaped annular springs made of super-elastic material.

15. A piston as claimed in claim 14, wherein the super-elastic material is cold worked and heat treated Gum Metal (an alloy of titanium, niobium, tantalum, zirconium and oxygen).

16. A piston as claimed in claim 14, wherein each of the springs has an outer, generally hemispherical edge portion which tapers towards an inner, generally hemispherical edge portion via planar surfaces, and wherein the outer, generally hemispherical edge portions of the two springs are in rolling engagement with one another, and the inner, generally hemispherical edge portions are in rolling engagement with respective first and second support members provided within the crown of the piston.

17. A piston as claimed in claim 14, further comprising a carrier positioned within the piston, the carrier being slidably mounted within the piston for axial movement relative thereto, and being connected to the connecting rod in such a manner that the springs permits the carrier to move axially relative to the crown of the piston.

18. A piston as claimed in claim 17, wherein the first support member is press-fitted to the crown of the piston, and the second support member forms part of the carrier.

19. A piston as claimed in claim 17, wherein the carrier is coated with a friction-reducing material.

20. A piston as claimed in claim 17, wherein the carrier is slidably mounted within the cylindrical wall of the piston over substantially its entire length.

* * * * *